United States Patent [19]

Skala

[11] 4,338,785

[45] Jul. 13, 1982

[54] EXHAUST GAS TREATMENT BY A REACTANT

[76] Inventor: Stephen F. Skala, 3839 S. Wenonah Ave., Berwyn, Ill. 60402

[21] Appl. No.: 81,668

[22] Filed: Oct. 4, 1979

Related U.S. Application Data

[63] Continuation-in-part of Ser. No. 301,285, Oct. 27, 1972, abandoned, Ser. No. 457,207, Apr. 2, 1974, Pat. No. 3,911,284, Ser. No. 463,454, Apr. 26, 1974, abandoned, Ser. No. 578,527, May 19, 1975, Pat. No. 4,020,798, and Ser. No. 779,788, Mar. 21, 1977, Pat. No. 4,189,916.

[51] Int. Cl.[3] ..... F01N 3/02

[52] U.S. Cl. ..... 60/311; 60/39.46 R; 123/1 A

[58] Field of Search ..... 123/1 A, 570; 60/274, 60/311, 39.46 R, 39.46 S; 55/76, 96, 242, 243, 284

[56] References Cited

U.S. PATENT DOCUMENTS

| | | | |
|---|---|---|---|
| 2,409,386 | 10/1946 | Pridonoff et al. | 55/76 X |
| 2,956,559 | 10/1960 | Johnson | 123/570 X |
| 3,903,694 | 9/1975 | Aine | 60/311 X |

*Primary Examiner*—Tony M. Argenbright
*Attorney, Agent, or Firm*—Stephen F. Skala

[57] ABSTRACT

In a system and process which forms reaction products particulates in an exhaust gas, a substantial portion of the reaction products are separated in a concentrated form by a first stage for delivery to a collector and reaction products remaining in the exhaust gas are separated by a final stage which incorporates the reaction products in one reactant. The reactant incorporating the reaction products subsequently reacts and repeatedly passes through the stages of separation thereby collecting substantially all of the reaction products in concentrated form by the first stage and providing a clean exhaust gas after the final stage without adding substantially to system weight or complexity. In the preferred embodiment of a vehicle system having an internal combustion engine based on a reaction of NaK with water in the presence of air, NaK hydroxide particulate reaction products are separated from a nitrogen exhaust gas in a first stage impingement separator, are accumulated in a final stage filter, and are dissolved by the water which subsequently reacts with NaK.

11 Claims, 2 Drawing Figures

EXHAUST GAS TREATMENT BY A REACTANT

CROSS-REFERENCES TO RELATED APPLICATIONS

Ser. No. 950,845 entitled Internal Combustion Engine Based on Reactant Contact Ignition.

BACKGROUND

This application is a continuation-in-part of Ser. No. 301,285 filed Oct. 27, 1972 and now abandoned; and is a continuation-in-part of Ser. No. 457,207 filed Apr. 2, 1974 and now U.S. Pat. No. 3,911,284; and is a continuation-in-part of Ser. No. 463,454 filed Apr. 26, 1974 and now abandoned; and is a continuation-in-part of Ser. No. 578,527 filed May 19, 1975 and now U.S. Pat. No. 4,020,798; and is now a continuation-in-part of Ser. No. 779,788 filed Mar. 21, 1977, now U.S. Pat. No. 4,189,916.

This invention relates to a method and apparatus for exhaust gas treatment and particularly to such treatment where a reactant incorporates its reaction product in a final separation phase.

In a fuel and vehicle system described in the cited applications and patents, the eutectic alloy of sodium and potassium called NaK functions as a secondary energy source. A vehicle derives energy from a NaK-water-air reaction and forms NaK hydroxide in the process. The NaK hydroxide is removed from the vehicle for reduction back to NaK metal during refueling with NaK and water. One vehicle type has an internal combustion engine wherein NaK and water are injected into air compressed in a cylinder. The NaK and water react upon contact to form NaK hydroxide and hydrogen. The hydrogen then reacts with oxygen to complete the reaction. Upon expansion, the NaK hydroxide condenses into molten particulates which are suspended in an exhaust gas consisting of nitrogen with small amounts of water vapor and remaining oxygen. It is necessary to separate the NaK hydroxide particulates from the nitrogen exhaust gas both to allow recycling of the NaK hydroxide back to the NaK metal reactant and to preclude any contamination of the atmosphere by the particulates. But convenient separation means such as centrifugal or impingement separators are only partly effective and pass a portion of entrained particulates. Highly effective separators such as filters require frequent removal of accumulated particulates which, in a conventional flushing process, undesirably would add a substantial weight of liquid to vehicle weight and would dilute the particulate reaction products.

It is accordingly an object of this invention to provide an improved method and apparatus for separating such reactants from an exhaust gas.

It is another object to provide collection of the reaction products completely and in concentrated form without adding substantially to system weight or complexity.

SUMMARY

These and other objects and advantages which will become apparent are attained by the invention wherein an exhaust gas with entrained reaction products passes through a first stage of separation, which collects a substantial portion of the reaction products in a concentrated form, and passes through a final stage of separation which collects substantially all of the reamaining reaction products, releases a pure gaseous exhaust to the atmosphere, and incorporates the reaction products collected in the final stage into a reactant for subsequent passages through the first stage with collection therein of substantially all of the reaction products in a concentrated form.

In the preferred embodiment of the invention, NaK and water react in the presence of air to produce work while forming a mist of molten NaK hydroxide particulates in an exhaust gas most of which particulates are separated in a first stage of separation and substantially all of which remaining particulates are separated from the exhaust gas in a final stage of separation, the final stage being characterized as dissolving the separated NaK hydroxide in the water which subsequently reacts with the NaK to form additional NaK hydroxide particulates for separation from exhaust gas. Use of the same water in the same reservoir both as a reactant and as a solvent for the reaction products provides a more simple and less massive water reservoir system for the vehicle described than would separate water reservoirs for a reactant and a solvent.

One type of final separation stage comprises two filters functioning alternately between the separation of particulate reaction products and restoration of the filter by flushing with the water to dissolve the accumulated NaK hydroxide particulates.

One type of first separation stage, using the system characteristic that exhaust temperatures are normally above the melting temperature of the NaK hydroxide, comprises impingement of the NaK hydroxide particulates in the exhaust gas upon a molten surface of previously accumulated NaK hydroxide. The particulates cohere to the NaK hydroxide surface and are thereby separated from the exhaust gas.

DESCRIPTION OF THE DRAWINGS

FIG. 1 shows, as the preferred embodiment, a vehicle system including an internal combustion engine based on a NaK-water-air reaction, a first stage of separation for NaK hydroxide reaction products, and a final stage of separation comprising filters which are flushed alternately to dissolve accumulated NaK hydroxide by the same water which is also used as a reactant.

Figure 1:
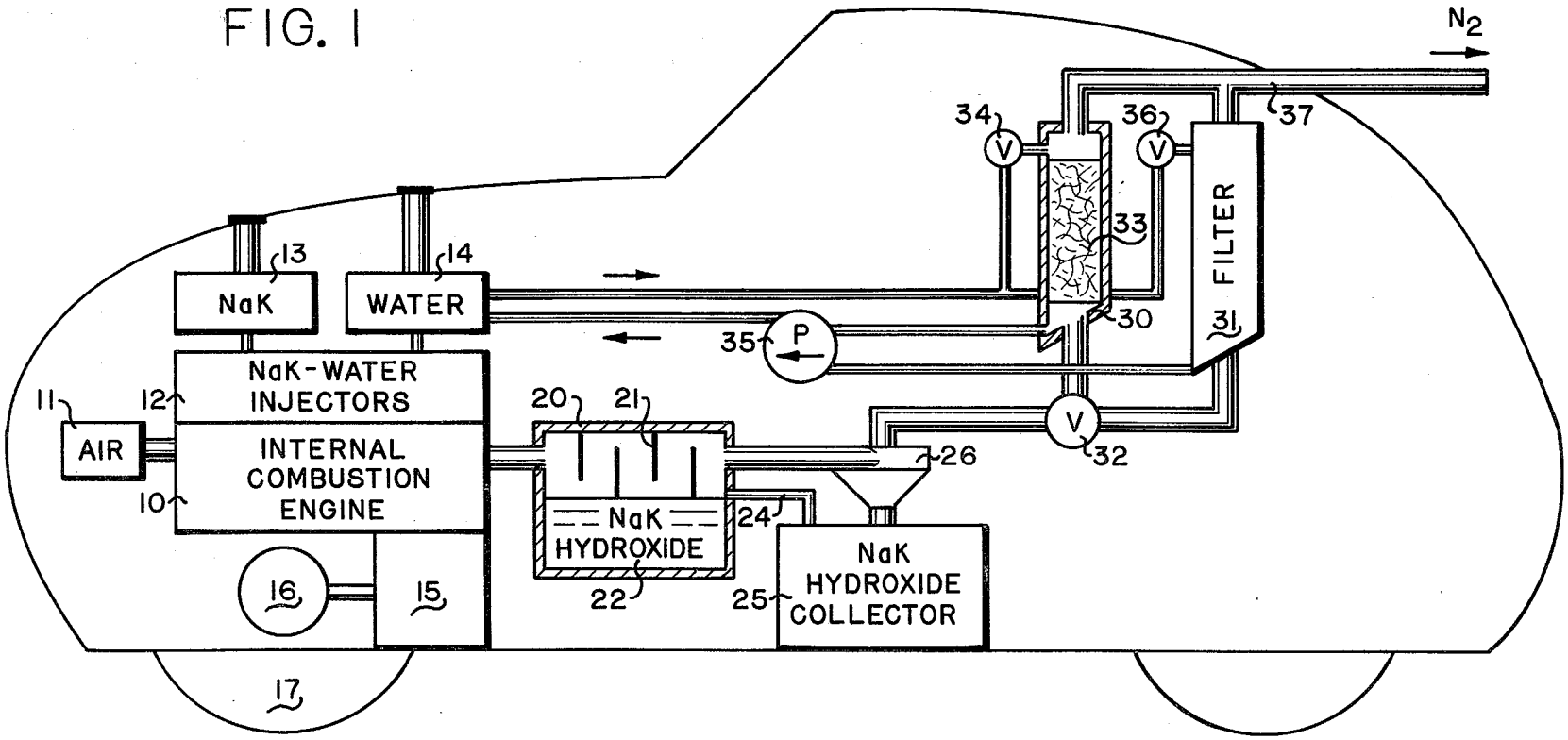
FIG. 1 is a diagrammatic representation of a vehicle system showing separation of reaction products from an exhaust gas according to the preferred embodiment of the invention.

An internal combustion engine 10 has combustion chambers, not shown, in which air from air intake 11 is compressed and into which NaK and water are injected by NaK-water injector assembly 12. Injectors for NaK connect to NaK reservoir 13 and injectors for water connect to water reservoir 14. Power developed from the heat of reaction is transmitted through transmission 15 through differential 16 to drive wheels 17. The internal combustion engine, which is described in more detail in the cross-referenced application, may have a familiar multicylinder open chamber configuration differing structurally from conventional engines principally in its use of two reactant injectors. The power train following the engine is conventional. The engine is unique in that its mechanical power is derived from heat energy released during contact of reactants having negligible activation energy of reaction of which reactants NaK and water are preferred. This novel reactant contact ignition reaction overcomes ignition delay and detonation problems of Otto and Diesel engines which result from substantial activation energies of conventional fuels. One characteristic of the present engine is that self starting can be based upon injection of the reactants into a combustion chamber in an expansion phase. Another characteristic is that simple open chamber cylinder structures can be used at optimal compression ratios in small automotive engines. Further water injection can be adjusted to limit maximum temperature to reduce formation of gaseous oxides of nitrogen which are further reduced by formation of alkali salts of the acidic oxides of nitrogen. With air as well as water in excess of stoichiometric quantities to assure complete reaction of NaK and evolved hydrogen, the principle reaction product is hydroxides of NaK with trace amounts of nitrates and nitrites of NaK. The principal exhaust gas is nitrogen with small amounts of water vapor and unreacted oxygen. The NaK hydroxide condenses from a vapor into a mist of molten particulates suspended in the exhaust gas which remain molten in a hot exhaust system.

During an exhaust phase of a cylinder, the particulates and gas are expelled from the engine into a first stage of separation which is impingement separator 20. A film of molten NaK hydroxide adheres to surfaces such as baffle plates 21. When the particulates impinge upon the molten NaK hydroxide on the baffle plates or upon the body of NaK hydroxide 22, they cohere and a substantial portion of the particulates is separated from the exhaust gas. Accumulating NaK hydroxide flows through overflow pipe 24 into NaK hydroxide collector 25. The first stage of separation may include additional separators such as a cyclone separator 26 which functions principally to remove particulates solidified after a cold start before exhaust system temperatures are above the melting temperature of NaK hydroxide. Operation of the cyclone separator is conventional with gas and particulates entering tangentially, with particulates concentrated by centrifugal force in the outer portion which spins downward into the NaK hydroxide collector, and with the cleaner inner portion moving upward to continue through the exhaust system.

A final stage of separation, which removes substantially all remaining NaK hydroxide particulates from the exhaust gas, dissolves the remaining particulates in water from the water reservoir. In the present embodiment, the final stage of separation comprises filters from which accumulated NaK hydroxide is dissolved by water. A first filter 30 and a second filter 31 of similar structure are operated alternately. When valve 32 directs flow of the exhaust gas and NaK hydroxide particulates through the first filter 30, the NaK hydroxide adheres to a filter material 33 which may consist of nickel fibers having in a portion thereof sufficiently small separations to ensure capture of remaining particulates. As an excessive quantity of NaK hydroxide accumulates, a pressure sensor not shown across the filter detects a large pressure differential and initiates a transfer of flow to the second filter by means of valve 32. Valve 34 then opens for a predetermined time and pump 35 operates to circulate water from the water reservoir, through the first filter to dissolve the accumulated NaK hydroxide, and back to the water reservoir. Similarly, when a large pressure differential develops across the second filter 31, valve 32 transfers flow of the exhaust gas and particulates back to the first filter 30, valve 36 opens and pump 35 circulates the water through the second filter and the water reservoir for a predetermined time normally sufficient to dissolve all of the accumulated NaK hydroxide. Exhaust gas entering the atmosphere from exhaust pipe 37 is substantially free of NaK hydroxide.

NaK hydroxide is removed from the collector 25 during a fuel stop as the NaK reservoir 13 and the water reservoir 14 are being filled. The NaK hydroxide is normally in a solid phase at ambient temperatures. The collector has the form of a side opening hopper, not shown, to allow the NaK hydroxide to drop into a service facility receiver for subsequent transport to a regenerating plant and conversion back to NaK metal.

It is apparent that the foregoing description is consistent with any of the alkali metals or their combinations substituted for NaK. The description is also consistent with other reactant pairs in which the reaction product is soluble in one of the reactants and which have a reaction product which is molten at exhaust temperatures.

Figure 2:
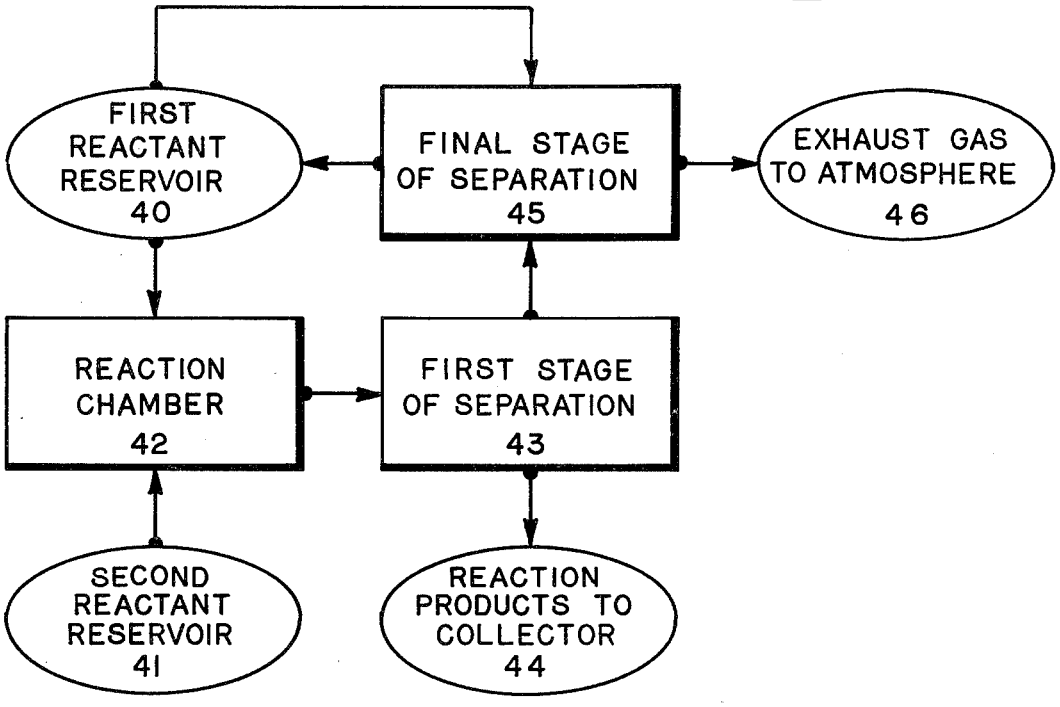
FIG. 2 is a block diagram showing flow of reactants, reaction products, and exhaust gas through a general embodiment of the invention.

FIG. 2 shows a general embodiment of the invention wherein a reactant incorporates its reaction product in a final stage of separation and the reactant with the incorporated reaction product subsequently reacts to form additional reaction products which progress again through the stages of separation thereby yielding the reaction product in a concentrated form for removal and providing a clean exhaust gas without adding substantially to weight or cost of the system.

A first reactant 40 and a second reactant 41 react in a reaction chamber 42 to form reaction products in an exhaust gas of which reaction products a substantial portion is separated from the exhaust gas in a first stage of separation 43 for transport to a collector 44. The exhaust gas with remaining reaction products is further processed in a final stage of separation 45 which is characterized by an incorporation of the reaction products separated in the final stage of separation in the first reactant. A substantially pure exhaust gas 46 is exhausted to the atmosphere. The first reactant with the incorporated reaction products is then recycled through the reaction chamber, preferably from the first reactant reservoir as shown or, alternatively, by delivery directly to the reaction chamber which is not shown.

Reactant pairs other than alkali metals with water have the property that the reaction product is soluble in one of the reactants. One example is sodium and ethanol which react upon contact to form hydrogen and sodium ethoxide which is soluble in ethanol as the first reactant. Sodium ethoxide particulates in a hydrogen exhaust gas formed in the reaction chamber are separated in the first and final stages of separation. The sodium ethoxide is incorporated into the ethanol in the final stage of separation and returned to the first reactant reservoir for subsequent reaction and separation. Another example of a reactant pair having a reaction product which is soluble in one of the reactants is diborane and water which form hydrogen and boric acid. At high reaction temperatures, the boric acid decomposes to water and boron oxide which is soluble in hot water. Boron oxide forms molten particulates as it condenses from a vapor so that the system of FIG. 1 could be used for separation of the boron oxide particulates from the hydrogen exhaust gas.

The first stage of separation retains the concentration of the reaction products for efficient storage in the collector and removes a sufficient quantity of the reaction products from the exhaust gas to avoid overloading the final stage of separation which would result if the first reactant became saturated with the reaction product. Examples of simple and reliable apparatus for the first stage of separation are the impingement separator and the cyclone separator described previously. Other separators based on retention of particulates in previously collected reaction products include wet venturi, spray tower, flooded disk, and submerged bubbler types wherein a body of reaction products in a liquid phase provides a scrubbing medium.

The final stage of separation prevents loss of useful reaction products and provides an exhaust gas of acceptable purity. One of the reactants dissolves or otherwise incorporates the reaction products remaining in the exhaust gas entering the final stage of separation and then returns to the first reactant reservoir. In order to avoid loss of the reactant incorporating the reaction product to the atmosphere by vaporization in a hot exhaust gas, particulate separation is a process separate from removal of the accumulated reaction products by the first reactant. One embodiment of such separation and regeneration is the alternating filter assembly described with reference to FIG. 1. Another embodiment which provides a continuous flow of the exhaust gas stream and of the first reactant is based on a filter medium in the form of an annular disk which rotates through the exhaust gas stream at one position and through the first reactant stream at another position. Rotation of the filter is propotional to reactant reaction rate. Other embodiments having reactants which would not vaporize or react in the exhaust gas can use various types of scrubbers or packed columns operating with simultaneous flows of the exhaust gas and the first reactant through the same portions of the separator. The first reactant is then returned to the first reactant reservoir for subsequent reaction. Such embodiments may incorporate the reaction products into the reactant as a suspension or slurry as well as a solute.

What I claim is:

1. A method for separating and collecting reaction products from exhaust gases, comprising the steps of:

reacting a first reactant and a second reactant in a combustion chamber to form the reaction products in the exhaust gases, separating a portion of the reaction products from the exhaust gases in a first stage of separation and collecting the reaction products in a concentrated form, separating substantially all of the remaining reaction products from the exhaust gases in a final stage of separation and releasing the exhaust gases to the atmosphere, incorporating the reaction products separated in the final stage of separation into the first reactant, and reacting the first reactant having incorporated therein the reaction products separated in the final stage of separation with the second reactant in the combustion chamber whereby the incorporated reaction products are included in the separation of the first stage of separation and thus circulate until substantially all of the reaction products are collected in concentrated form by the first stage of separation.

2. A method for separating alkali hydroxide reaction products from exhaust gases, comprising the steps of:

reacting water and an alkali metal to form the alkali hydroxide in the exhaust gases, separating a portion of the alkali hydroxide from the exhaust gases in a first stage of separation, incorporating at least a portion of the remaining alkali hydroxide into the water in a final stage of separation, and reacting the water having the alkali hydroxide incorporated therein with the alkali metal whereby the alkali hydroxide which was incorporated into the water is again partly separated in the first stage of separation and continues to circulate until substantially all of the alkali hydroxide is separated therein.

3. A method for separating molten particulate reaction products from exhaust gases, comprising the steps of:

reacting a first reactant and a second reactant to form the molten particulate reaction products in the exhaust gases, separating a portion of the molten particulate reaction products from the exhaust gases in a first stage of separation comprising the steps of directing the particulates and exhaust gases to impinge upon a surface of molten reaction products, said surface retaining at least some of the particulates, and directing said retained reaction products to a collector, incorporating at least a portion of the remaining reaction products into the first reactant in a final stage of separation, and reacting the first reactant having the incorporated reaction products therein with the second reactant thereby using the first reactant both to form the reaction products and to separate the reaction products from the exhaust gases.

4. The method of claim 3 wherein said reaction products are substantially an alkali hydroxide.

5. A system for separating reaction products from an exhaust gas, comprising:

a first reactant, a first reactant reservoir, and a second reactant, means to react the reactants in a combustion chamber to form reaction products in an exhaust gas, a first stage of separation to separate a portion of the reaction products from the exhaust gas and a collector to retain the reaction products separated in the first stage, a final stage of separation to substantially all remaining reaction products from the exhaust gas and to release the exhaust gas to the atmosphere, and conduits connecting the first reactant reservoir to the final stage of separation having means therein to incorporate the separated remaining reaction products into the first reactant transported therebetween whereby the separated remaining reaction products are delivered to the first reactant reservoir.

6. A system for separating reaction product particulates from an exhaust gas, comprising:

a first reactant, a first reactant reservoir, and a second reactant, means for reacting the first and second reactants in a combustion chamber to form reaction product particulates in the exhaust gas, a first stage of separation to separate a portion of the particulates from the exhaust gas comprising a liquid surface of the reaction products which were previously accumulated and means for directing the particulates and exhaust gas to impinge upon the liquid surface to accumulate the particulates thereon, a final stage of separation to separate substantially all remaining particulates from the exhaust gas and to release the exhaust gas to the atmosphere, and conduits connecting the first reactant reservoir to the final stage of separation having means therein for incorporating the separated remaining reaction product particulates into the first reactant which is transported therebetween whereby the separated remaining reaction products are delivered to the first reactant reservoir.

7. The system of claim 6 wherein the particulates are soluble in the first reactant and said means to separate all remaining reaction products from the exhaust gas and means to incorporate the remaining reaction products into the first reactant comprise a filter; means to direct flow of the particulates and the exhaust gas therethrough to retain the particulates therein; means to stop said flow; and means to pass a portion of the first reactant through the filter to dissolve said particulates and restore the filter for subsequent separation of the particulates from the exhaust gas.

8. The system of claim 7 wherein the first reactant is water, the second reactant is an alkali metal, the reaction products are alkali hydroxide particulates, and the exhaust gas is substantially nitrogen.

9. A system for separating reaction products from an exhaust gas comprising in combination an internal combustion engine having means for reacting an alkali metal and water in the presence of air to form reaction products comprising alkali hydroxide particulates in an exhaust gas, a reservoir for the water and means to deliver the water from the reservoir to said means for reacting the water with the alkali metal, means to separate a portion of the particulates from the exhaust gas, a filter to remove substantially all remaining particulates from the exhaust gas passing therethrough, and means to deliver a portion of the water from the reservoir through the filter to dissolve the alkali hydroxide accumulated therein and to return the water incorporating the dissolved alkali hydroxide to the reservoir.

10. The system of claim 9 wherein said means to separate a portion of the particulates from the exhaust gas comprises a surface of molten alkali hydroxide toward which surface the particulates and exhaust gas are directed for retention of the particulates.

11. The system of claim 10 wherein the alkali metal is NaK.

* * * * *